United States Patent [19]

Maguire, Jr. et al.

[11] 4,090,973

[45] May 23, 1978

[54] METHOD FOR MAKING STABLE DETERGENT COMPOSITIONS

[75] Inventors: Edward John Maguire, Jr.; Eugene J. Pancheri, both of Cincinnati, Ohio

[73] Assignee: The Procter & Gamble Company, Cincinnati, Ohio

[21] Appl. No.: 699,417

[22] Filed: Jun. 24, 1976

[51] Int. Cl.[2] ..... C11D 7/42

[52] U.S. Cl. ..... 252/89 R; 252/DIG. 3; 252/DIG. 12; 252/DIG. 15; 252/160; 252/174; 252/135; 252/144; 427/212; 427/220; 427/221; 427/337; 427/384

[58] Field of Search ..... 252/89 R, DIG. 3, DIG. 12, 252/DIG. 15, 160, 174, 144, 135; 427/212, 220, 221, 337, 384

[56] References Cited

U.S. PATENT DOCUMENTS

| | | | |
|---|---|---|---|
| 3,519,570 | 7/1970 | McCarty | 252/DIG. 12 |
| 3,775,331 | 11/1973 | Borrello | 252/89 R |
| 3,953,353 | 4/1976 | Barrett, Jr. et al. | 252/174 |

*Primary Examiner*—Mayer Weinblatt
*Attorney, Agent, or Firm*—Edmund F. Gebhardt; Richard C. Witte; Thomas H. O'Flaherty

[57] ABSTRACT

A method for preparing water-containing liquid detergent compositions containing components which are usually unstable in such systems, comprising encapsulating such components in a material at least 10% of which is a water-soluble normally solid alkoxylated nonionic surface active agent, preferably either polyethylene glycol with a molecular weight of from about 3000 to 40,000 or the condensation product of tallow alcohol with from about 20 to 80 moles of ethylene oxide. "Encapsulating" is broadly defined to include processes such as prilling, agglomerating, encapsulating, admixing, coating, noodling, flaking, and Marumerizing such components. Detergent compositions, which exhibit storage stability, containing such encapsulated components are also claimed.

13 Claims, No Drawings

METHOD FOR MAKING STABLE DETERGENT COMPOSITIONS

BACKGROUND OF THE INVENTION

There has been a long-standing desire to incorporate various components into detergent compositions, whose incorporation has not been feasible either because the particular components are not compatible with other particular components necessary in detergent compositions or because the detergent composition environment is generally hostile to the particular component sought to be incorporated. An example of the first type of problem is encountered when both an enzyme and a bleaching agent are put into a detergent composition. In such an instance, the bleaching agent tends to degrade the enzyme, thereby eliminating any cleaning benefit which the enzyme might afford. This is especially true where the detergent composition is a liquid, paste, foam, gel or other form in which the components are mobile. Thus, there has been work to develop bleach-free enzyme-containing detergent compositions.

An example of the second type of problem occurs when an enzyme is incorporated in a water-containing detergent composition designed for use in automatic dishwashers. Such detergent compositions are, by their nature, highly alkaline. The water in such compositions causes some of the alkaline components to ionize and these ions degrade the enzyme. Thus, after a relatively short period of storage, the detergent composition has lost the cleaning benefit which the enzyme affords.

Various approaches have been taken in order to permit the formulation of aqueous, alkaline detergent compositions containing enzymes. U.S. Pat. No. 3,472,783, Smillie, issued Oct. 14, 1969, recognized that the incorporation of an enzyme in an aqueous, alkaline detergent composition, will cause the enzyme to be denatured. As a result, the patent teaches substantially nonaqueous detergent compositions, not containing any alkaline builder salts, comprising a proteolytic enzyme and an ethoxylated nonionic surface active agent. A nonaqueous carrier, such as glycerine, may also be added to the compositions.

Another approach to permit the incorporation of enzymes in aqueous, alkaline detergent compositions has been to include enzyme-stabilizing agents in the compositions. Various stabilizing agents have been used. German Pat. No. 2,038,103, issued Feb. 10, 1972, to Henkel & Cie, discloses detergent compositions, containing enzymes, for use in automatic dishwashers, containing at least 40% water, and which include a sugar alcohol, a monosaccharide or a disaccharide which functions to stabilize the enzyme and prevent its degradation. U.S. Pat. No. 3,860,536, Landwerlen et al, issued Jan. 14, 1975, teaches enzyme-containing aqueous laundry detergent compositions which contain from 5 to 60% propylene glycol which stabilizes the enzymes in the aqueous detergent system. U.S. Published Patent Application B458,819, Weber, published Apr. 13, 1976, also discloses aqueous detergent compositions utilizing a stabilizing agent to prevent the degradation of the enzymes contained therein. The detergent compositions contain from 2 to 25% of specific detergency builder salts, from 5 to 30% of a specifically selected surface active agent, water, from 0.1 to 5% of a proteolytic enzyme, and from 5 to 40% of an enzyme stabilizing agent selected from alkali metal sulfates, alkali metal chlorides, glycerol and alkylene glycols having from 2 to 8 carbon atoms in the alkylene group.

It has now been found that by encapsulating a component, such as an enzyme, which would normally be unstable in a liquid water-containing detergent composition, in a material containing at least 10% by weight of a water-soluble normally solid alkoxylated nonionic surface active agent, preferably either polyethylene glycol having a molecular weight of from about 3000 to about 40,000 or the condensation product of tallow alcohol with from about 20 to about 80 moles of ethylene oxide, such components may be incorporated into such compositions, and will exhibit stability over periods of storage.

Accordingly, it is an object of this invention to permit the formulation of liquid water-containing detergent compositions which include beneficial components which would usually be unstable in such compositions.

It is a further object of this invention to permit the formulation of liquid water-containing detergent compositions which exhibit stability and effectiveness after periods of storage.

The above and other objects are now achieved by formulating the liquid detergent compositions as described below.

SUMMARY OF THE INVENTION

This invention comprises a method for preparing liquid detergent compositions containing normally incompatible components, said compositions containing from about 0.5% to about 30% by weight of water, up to about 10% of said composition being present as free water, the remainder of the water being present as water of hydration, comprising encapsulating said incompatible components in a material, at least about 10% by weight of which is a water-soluble, normally solid alkoxylated nonionic surface active agent.

The present invention also comprises liquid, water-containing detergent compositions which contain the normally incompatible detergent components, encapsulated as described below.

Preferred detergent compositions of the present invention are in the form of a viscous liquid, slurry, foam, paste or gel and contain from about 0.5% to about 20%, more preferably 1% to about 10% of a surface active agent. Preferred surface active agents are alkoxylated nonionic surface active agents wherein the alkoxy moiety is selected from the group consisting of ethylene oxide, propylene oxide and mixtures thereof.

DETAILED DESCRIPTION OF THE INVENTION

The present invention encompasses a method whereby various desirable components, which would normally undergo degradation after long periods of storage in a liquid detergent composition, may be stably included in such detergent compositions. The components which may be beneficially included in such liquid compositions, utilizing the method of this invention, include, for example, enzymes, suds suppressors, perfumes, bleaching agents, reducing agents, or any other component which exhibits long-term storage instabilities when included in liquid detergent compositions.

The detergent compositions utilized in the method of the present invention must be liquid in nature. As used herein, the term "liquid" includes liquids, viscous liquids, slurries, foams, pastes, and gels. The particular form which a detergent composition takes may be dictated, at least in part, by the use for which the composition is intended. For example, if a detergent composition is formulated for use in an automatic dishwasher, it is most advantageously formulated as a viscous liquid, paste, or gel, such that it will not leak out of the detergent dispenser in the automatic dishwasher, when it is used. If such compositions are formulated for use in an automatic dishwasher in liquid form, the liquid should be thixotropic (i.e., exhibit high viscosity when subjected to low stress and lower viscosity when subjected to high stress) or at least have a very high viscosity, e.g., in the range of 1,000 to 10,000,000 centipoise. Pasty compositions for use in an automatic dishwasher generally have viscosities above about 5,000 centipoise and up to several hundred million centipoise.

The detergent composition with which the method of the present invention may be utilized, further must contain from about 0.5% to about 30%, preferably 5% to 25%, and most preferably 7% to 20%, by weight of water. Of this total amount of water present in the detergent composition, up to about 10% of the total composition, preferably 0.05% to about 5%, may be present as free water, with the remainder of the water being present as water of hydration. The inclusion of water tends to lower the cost of making the compositions, decrease their flammability, and improve the dispersion of the components in the compositions. The presence of more than about 30% of water, or more than about 10% of free water, in the composition will result in solubilizing the encapsulating material in the detergent composition, and hence will decrease the stability of the encapsulated components. The level of water of hydration in the detergent composition varies depending upon the amount of hydrated components contained therein. For example, by increasing or decreasing the amount of sodium tripolyphosphate hexahydrate or hydrous silicate contained in the composition, the amount of water of hydration contained in said composition may be varied.

In the method of the present invention, the incompatible components to be incorporated in the liquid detergent composition are encapsulated in a material comprising specifically selected compounds, prior to their inclusion in the detergent composition. As used herein, the term "encapsulated" is broadly defined to include any method whereby the additive component and the selected encapsulating material are comixed and are formed into discrete particles for addition into the detergent composition. Thus, as used herein, the term "encapsulated" includes the operations known in the art as prilling, encapsulating, agglomerating, noodling, comixing, coating, flaking, shredding, Marumerizing and the like. A method by which the additive component may be covered by an outer shell of the encapsulating material is described in U.S. Pat. No. 3,310,612, Somerville, issued Mar. 21, 1967, incorporated herein by reference. A prilled product can be formed by spraying a melt of the encapsulating material with the additive component in a tower through which a cold stream of air is introduced, causing the spray melt to solidify into small spheres or the like. An example of such a process is described in *The Chemical Engineer,* No. 304, December 1975, pp. 748–750, and in U.S. Pat. No. 3,742,100, incorporated herein by reference. The process of Marumerizing comprises the subjecting of additive component-containing pellets, prepared by the extrusion of a mixture of the additive component together with the encapsulating material, to a spheroidizing process using a rotational speed of up to 2,000 rpm in an apparatus causing centrifugal and frictional forces to be applied to the pellets. An example of a Marumerizing process is described in British Pat. Specification No. 1,361,387.

The encapsulating material for use in the method of the present invention comprises at least about 10%, and preferably at least 30%, by weight of a water-soluble normally solid alkoxylated nonionic surface active agent. The alkoxylated nonionic surface active agents described in this specification, especially those wherein the alkoxy moiety is ethylene oxide, are useful as encapsulating materials in the present invention. Preferred alkoxylated surfactants include those selected from the group consisting of polyethylene glycol having a molecular weight of from about 3000 to about 40,000, the condensation product of tallow alcohol with from about 20 to about 80 moles of ethylene oxide, and mixtures thereof. Polyethylene glycols having a molecular weight of from about 3000 to about 8000, particularly from about 6000 to about 20,000, are particularly useful in the present invention. For example, the Dow Chemical Company manufactures these compounds in molecular weights of 7500, 4500, and 3400. All of these polyethylene glycols, useful in the method of the present invention, are wax-like solids which melt between 100° F and 200° F. A particularly preferred polyethylene glycol has a molecular weight of about 6000. The condensation product of one mole of tallow alcohol with from about 20 to about 80 moles, particularly about 20 to about 30 moles, of ethylene oxide are also especially useful as encapsulating materials in the method of the present invention. The encapsulating material useful in the method of the present invention must contain at least about 10%, and preferably at least 30%, by weight of these specifically selected encapsulating materials. The remainder of the encapsulating mixture may comprise more conventional, normally solid, water-insoluble materials which are more generally used for "encapsulating" particles in aqueous systems. Examples of such agents include paraffin wax, beeswax, microcrystalline and oxidized microcrystalline petrolatum waxes, Fischer-Tropsch and oxidized Fischer-Tropsch waxes, ozokerite, ceresin, montan wax, candelilla, carnauba wax, saran, and both natural and man-made polymers, such as cellulose and polymaleic anhydride. Preferred materials for use in the present invention include paraffin wax, saran, beeswax, and triglycerides. In addition to the alkyoxylated alcohols, lower levels, i.e., less than about 10%, of other water-soluble encapsulating materials may also be incorporated. Examples of such components include carboxymethylcellulose, ethyl cellulose, gelatin, gum arabic and argar. Crosslinking agents, such as $TiO_2$ and Monomide S may also be included.

In the method of the present invention, after the additive incompatible component is combined with and encapsulated by the specifically selected encapsulating material, it is then added to the liquid detergent composition in an effective amount, so that the component will serve its desired function in the composition. The order of addition of the components of the detergent composition, does not affect its storage stability.

The compositions of the present invention may optionally contain from about 0.5% to about 30%, preferably from about 1% to about 10%, of a surface active agent. Surface active agents particularly useful in the compositions of the present invention include anionic, nonionic, ampholytic, and zwitterionic surface active agents. Mixtures of surface active agents may also be employed herein. More particularly, the surfactants listed in U.S. Pat. No. 3,717,630, Booth, issued Feb. 20, 1973, and U.S. Pat. No. 3,332,880, Kessler et al, issued July 25, 1967, each incorporated herein by reference, may be used in the present invention.

Nonionic surfactants are the preferred surfactants for use in the compositions of the present invention. Most commonly, nonionic surfactants are compounds produced by the condensation of an alkylene oxide, especially ethylene oxide (hydrophilic in nature) with an organic hydrophobic group, which is usually aliphatic or alkyl aromatic in nature. The length of the hydrophilic polyoxyalkylene moiety which is condensed with any particular hydrophobic compound can be readily adjusted to yield a water-soluble compound having the desired degree of balance between hydrophilic and hydrophobic properties. A typical listing of the classes and species of such nonionic surfactants useful herein appears in U.S. Pat. No. 3,664,961, incorporated herein by reference.

Particularly preferred nonionic surface active agents include alkoxylated nonionic surface active agents wherein the alkoxy moiety is selected from the group consisting of ethylene oxide, propylene oxide, and mixtures thereof. Ethylene oxide represents the preferred condensation partner. The alkylene oxide moiety is condensed with a nonionic base material according to techniques known in the art. All alkoxylated nonionic detergents which are normally known to be suitable for use in detergent technology can be used herein. Examples of such components include:

(1) The condensation product of one mole of a saturated or unsaturated, straight or branched chain carboxylic acid having from about 10 to about 18 carbon atoms with from about 5 to about 50 moles of ethylene oxide. The acid moiety can consist of mixtures of acids in the above delineated carbon atoms range or it can consist of an acid having a specific number of carbon atoms within this range. The condensation product of one mole of coconut fatty acid having the approximate carbon chain length distribution of 2% $C_{10}$, 66% $C_{12}$, 23% $C_{14}$ and 9% $C_{16}$ with 35 moles of ethylene oxide is a specific example of a nonionic containing a mixture of different chain lengths fatty acid moieties. Other specific examples of nonionics of this type are: the condensation product of one mole of palmitic acid with 40 moles of ethylene oxide; the condensation product of one mole of myristic acid with 35 moles of ethylene oxide; the condensation product of one mole of oleic acid with 45 moles of ethylene oxide; and the condensation product of one mole of stearic acid with 30 moles of ethylene oxide.

(2) The condensation products of one mole of a saturated or unsaturated, straight or branched chain alcohol having from about 10 to about 24 carbon atoms with from about 5 to about 50 moles of ethylene oxide. The alcohol moiety can consist of mixtures of alcohols in the above-delineated carbon atom range or it can consist of an alcohol having a specific number of carbon atoms within this range. The condensation product of one mole of coconut alcohol having the approximate chain length distribution of 2% $C_{10}$, 66% $C_{12}$, 23% $C_{14}$ and 9% $C_{16}$ with 45 moles of ethylene oxide ($CNAE_{45}$) is a specific example of a nonionic containing a mixture of different chain length alcohol moieties. Other specific examples of nonionics of this type are the condensation products of one mole of tallow alcohol with 9 and 20 moles of ethylene oxide respectively; the condensation products of one mole of lauryl alcohol with 35 moles of ethylene oxide; the condensation products of one mole of myristyl alcohol with 30 moles of ethylene oxide; and the condensation products of one mole of oleyl alcohol with 40 moles of ethylene oxide.

(3) Polyethylene glycols having a molecular weight of from about 1400 to about 30,000. For example, Dow Chemical Company manufactures these nonionics in molecular weights of 20,000, 9500, 7500, 4500, 3400 and 1450. All of these nonionics are waxlike solids which melt between 110° F and 200° F.

(4) The condensation products of one mole of alkyl phenol wherein the alkyl chain contains from about 8 to about 18 carbon atoms with from about 4 to about 50 moles of ethylene oxide. Specific examples of these nonionics are the condensation products of one mole of decyl phenol with 40 moles of ethylene oxide; the condensation products of one mole of dodecyl phenol with 35 moles of ethylene oxide; the condensation products of one mole of tetradecyl phenol with 35 moles of ethylene oxide; and the condensation products of one mole of hexadecyl phenol with 30 moles of ethylene oxide.

(5) The ethoxylated surfactants disclosed in U.S. Pat. Application Ser. No. 557,217, filed Mar. 10, 1975, inventor Jerome H. Collins, now abandoned, incorporated herein by reference, consisting essentially of a mixture of compounds having at least two levels of ethylene oxide addition and having the formula:

$$R_1 - R_2 - O(CH_2CH_2O)_nH$$

wherein $R_1$ is a linear alkyl residue and $R_2$ has the formula $$-CHR_3CH_2-$$

wherein $R_3$ is selected from the group consisting of hydrogen and mixtures thereof with not more than 40% by weight of lower alkyl, wherein $R_1$ and $R_2$ together form an alkyl residue having a mean chain length in the range of 8–15 carbon atoms, at least 65% by weight of said residue having a chain length within $\pm$ 1 carbon atom of the mean, wherein $3.5 < n < 6.5$, provided that the total amount of components in which $n = 0$ is not greater than 5% by weight and the total amount of components in which $n = 2$–7 inclusive is not less than 63% by weight, and the hydrophilic-lipophilic balance (HLB) of said ethoxylate materials is in the range from 9.5–11.5, said surfactant composition being otherwise free of nonionic surfactants having an HLB outside of said range.

Low-foaming alkoxylated nonionics are preferred although other (than low-foaming) alkoxylated nonionics can be used without departing from the spirit of this invention. Examples of nonionic low-foaming surface-active components include the condensation products of benzyl chloride and an ethoxylated alkyl phenol wherein the alkyl group has from about 6 to about 12 carbon atoms and wherein from about 12 to about 20 ethylene oxide molecules have been condensed per mole of alkyl phenol; polyetheresters of the formula $$(ClC_6H_4)_2CHCO_2(CH_2{\cdot}CH_2{\cdot}O)_xR$$

wherein $x$ is an integer from 4 to 20 and R is a lower alkyl group containing not more than 4 carbon atoms, for example a component having the formula $(ClC_6H_4)_2CHCO_2(CH_2CH_2O)_{15}\cdot CH_3$;

the polyalkoxylation products of alkyl phenol, for example, the polyglycol alkyl phenol ethers containing an alkyl group having at least 6 and, normally, from about 8 to about 20 carbon atoms and having a molar ratio of ethylene oxide to condensate of about 7.5; 9.0; 11.5; 20.5 and 30. The alkyl group can, for example, be represented by di-isobutylene; di-amyl; polymerized propylene; iso-octyl; and nonyl.

Additional examples of effective low-foaming nonionics include: the polyalkylene glycol condensates of U.S. Pat. No. 3,048,548, hereby incorporated by reference, having alternating hydrophilic oxyethylene chains and hydrophobic oxypropylene chains wherein the weight of the terminal hydrophobic chains, the weight of the middle hydrophobic unit and the weight of the linking hydrophilic units each represent about ⅓ of the condensate; the de-foaming nonionic surfactants disclosed in U.S. Pat. No. 3,382,178, incorporated herein by reference, having the general formula $Z[(OR)_nOH]_z$ wherein Z is alkoxylatable material, R is a radical derived from an alkylene oxide which can be ethylene and propylene and $n$ is an integer from, for example, 10 to 2000 or more and $z$ is an integer determined by the number of reactive oxyalkylatable groups. Z can be represented by normal biodegradable alcohols such as, for example, obtained by reduction of fatty acids derived from coconut oil, palm kernel oil, tallow and also those obtained from petroleum such as, for example, the mixtures of $C_{10}$ to $C_{18}$ straight-chain primary alcohols; the nonionic surface-active agents of U.S. Pat. No. 3,549,539 being a mixture of nonylphenol-5-EO or the condensation product of a random $C_{11}$ to $C_{15}$ secondary alcohol and ethylene oxide having an HLB value between 11.5 and 13.5; and a polyethylene oxide/polypropylene oxide condensate that consists of between 5 and 25% polyethylene oxide and 95 and 75% polypropylene oxide and has a molecular weight between 1500 and 2700; the conjugated polyoxyalkylene compounds described in U.S. Pat. No. 2,677,700, incorporated herein by reference, corresponding to the formula:

$Y(C_3H_6O)_n(C_2H_4O)_mH$ wherein Y is the residue of organic compound having from about 1 to 6 carbon atoms and one reactive hydrogen atom, $n$ has an average value of at least about 6.4, as determined by hydroxyl number and $m$ has a value such that the oxyethylene portion constitutes about 10 to 90 weight percent of the molecule; the conjugated polyoxyalkylene compounds described in U.S. Pat. No. 2,674,619, incorporated herein by reference, having the formula:

$Y[(C_3H_6O)_n(C_2H_4O)_mH]_x$ wherein $Y$ is the residue of an organic compound having from about 2 to 6 carbon atoms and containing $x$ reactive hydrogen atoms in which $x$ has a value of at least about 2, $n$ has a value such that the molecular weight of the polyoxypropylene hydrophobic base is at least about 900 and $m$ has a value such that the oxyethylene content of the molecule is from about 10 to 90 weight percent. Compounds falling within the scope of the definition for $Y$ include, for example, propylene glycol, glycerine, pentaerythritol, trimethylolpropane, ethylene diamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula:

$P[(C_3H_6O)_n(C_2H_4O)_mH]_x$ wherein P is the residue of an organic compound having from about 8 to 18 carbon atoms and containing $x$ reactive hydrogen atoms in which $x$ has a value of 1 or 2, $n$ has a value such that the molecular weight of the polyoxypropylene portion is at least about 58 and $m$ has a value such that the oxyethylene content of the molecule is from about 10 to 90 weight percent and the formula:

$P[(C_2H_4O)_n(C_3H_6O)_mH]_x$ wherein P is the residue of an organic compound having from about 8 to 18 carbon atoms and containing $x$ reactive hydrogen atoms in which $x$ has a value of 1 or 2, $n$ has a value such that the molecular weight of the polyoxyethylene portion is at least about 44 and $m$ has a value such that the oxypropylene content of the molecule is from about 10 to 90 weight percent. In either case the oxypropylene chains may contain optionally, but advantageously, small amounts of ethylene oxide and the oxyethylene chains may contain also optionally, but advantageously, small amounts of propylene oxide.

Preferred nonionic surfactants for use in the present invention include the mono- and polyalkoxy substituted surfactants having the terminal hydroxyl of the alkoxy group acylated by certain mono basic acids (known as "capped" surfactants), described in U.S. Pat. application Ser. No. 621,456, Williams, filed Oct. 10, 1975, incorporated herein by reference.

Highly preferred alkoxylated nonionics for use herein include the condensation product of one mole of tallow alcohol with from about 6 to about 20 moles, especially 9 moles of ethylene oxide; the alkoxylate commercially available under the tradename Pluradot HA-433, Wyandotte Chemical Corporation, which has a molecular weight in the range from 3,700 to 4,200 and contains about 3% monosteryl acid phosphate suds suppressor; and also the condensation product of a $C_{14-15}$ alcohol with from 5 to 17 moles, particularly 7 to 9 moles, of ethyleneoxide. An example of such a surfactant is the condensation product of the alcohol with about 7 moles of ethylene oxide, commercially available as Neodol 45-7, from the Shell Chemical Corporation.

In addition to the ingredients described hereinbefore, other optional nonessential, compatible and noninterfering components may be added to the liquid detergent compositions, to provide improved performance or aesthetic appeal, depending upon the intended use of the particular detergent compositions. Such ingredients may include, but are not limited to, organic and inorganic detergent builder materials, alkali materials, sequestering agents, china protecting agents, reducing agents, enzymes, enzyme stabilizing agents, hydrotropes, corrosion inhibitors, soil suspending ingredients, drainage promoting ingredients, bleach compounds, suds regulating agents such as suds boosters and suds suppressing agents, tarnish inhibitors, buffering agents, brighteners, perfumes, dyes, inert carriers, and mixtures thereof.

Aside from the added storage stability, an additional advantage achieved through the use of the method of the present invention with regard to enzymes incorporated into detergent compositions, is that sensitization concerns which would be caused by the enzymes are minimized thereby. Particularly preferred enzymes with regard to this aspect of the invention are the proteolytic enzymes SP-72 (ESPERASE) and SP-88 and the amylolytic enzyme TERMAMYL, commercially available from Novo Industrial A/S, Copenhagen, Denmark. Preferred enzymes are described in U.S. Pat. No. 3,827,938, British Pat. Specification No. 1,361,386 and British Pat. Specification No. 1,296,839, incorporated herein by reference.

Builder materials useful in the present invention may be either organic or inorganic in nature. Suitable inorganic builders include polyphosphates, for example sodium or potassium tripolyphosphate, pyrophosphate or metaphosphate; carbonates, bicarbonates, and silicates (e.g., metasilicates and those having $SiO_2$:$Na_2O$ ratios of 1.6, 1.8, 2.0, 2.4, 2.6, 2.8, etc.). Particularly preferred are the sodium and potassium salts of the aforementioned inorganic builders. Examples of water-soluble organic builder components include the alkali metal salts, especially sodium or potassium, of polyacetates, carboxylates, polycarboxylates, and polyhydroxy sulfonates. Additional examples include sodium citrate, sodium oxydisuccinate, and sodium mellitate.

Particularly preferred suds suppressing agents are those disclosed in U.S. Pat. No. 3,933,672, and U.S. Pat. application Ser. No. 622,303, Gault et al, filed Oct. 14, 1975, now abandoned, incorporated herein by reference.

The following examples are illustrative of the method and the compositions of the present invention, but are not intended to be limiting thereof.

EXAMPLE I

Liquid detergent compositions having the following formulae were prepared using conventional methods.

| Ingredient | Composition A | B | C | D |
|---|---|---|---|---|
| Condensation product of tallow alcohol with 9 moles ethylene oxide ($TAE_9$) | 10.0 | — | — | 7.6 |
| Condensation product of $C_{14-15}$ alcohol with 7 moles ethylene oxide (Neodol 45-7) | — | 5 | 5 | — |
| Butyl carbitol | 8.0 | — | — | — |
| SAG 100 (1) | 1.0 | — | — | — |
| Triethanolamine | 19.6 | 25 | 25 | 7.6 |
| Sodium tripolyphosphate (anhydrous) | — | — | — | 19 |
| Sodium tripolyphosphate . 6 $H_2O$ | 25.0 | 30 | 30 | — |
| Sodium carbonate | 5.2 | — | — | — |
| 1.6r wet silicate | — | — | — | 61 |
| 2.0r anhydrous silicate | — | 5 | — | — |
| 2.4r hydrous silicate | 30.0 | 20 | 25 | — |
| Sodium sulfate | — | — | 8 | — |
| Polyethylene glycol 4000 | — | 1 | 2 | — |
| SP-72 (2) | 1.2 | 3 | — | — |
| Alcalase (3) | — | — | 5 | 4.8 |
| Minors and moisture | BALANCE | | | |
| Total water in composition (approx.) | 12% | 12% | 35% | 12% |

-continued (1) a polydimethyl siloxane suds suppressor, sold by Union Carbide
(2) a proteolytic enzyme commercially available from Novo Industrial A/S -- used in a surfactant slurry
(3) a proteolytic enzyme commercially available from Novo Industrial A/S The enzyme component in composition A was incorporated into the composition as a surfactant slurry; in composition B the enzyme was encapsulated in polyvinyl alcohol prior to incorporation; and in compositions C and D the enzymes were encapsulated in polyethylene glycol 6000 prior to incorporation.

After each composition was formulated, its proteolytic activity, resulting from the inclusion of the enzyme, was measured using the dimethyl casein method. Each composition was then stored at room temperature (72° F) and its proteolytic activity was redetermined at periodic intervals. Decreases in proteolytic activity are indicative of enzyme decomposition. The results obtained were as follows:

| Times (Days) | Proteolytic Activity (Anson Units/g) A | B | C | D |
|---|---|---|---|---|
| Formulated activity | .022 | .022 | .05 | .05 |
| ½ | — | .022 | — | — |
| 1 | .024 | — | — | — |
| 7 | — | .008 | — | — |
| 9 | — | — | .03 | .05 |
| 14 | .015 | — | — | — |
| 19 | — | — | .00 | .044 |
| 22 | — | — | — | .044 |
| 28 | .010 | — | — | — |
| 30 | — | — | — | .045 |
| 35 | .005 | — | — | — |
| 43 | — | — | — | .045 |

The data indicates that composition D, wherein the enzyme was encapsulated in a material falling within the scope of the present invention, and wherein the water content of the composition was within the critical range, exhibited good enzyme storage stability over the test period. The other compositions exhibited relatively rapid enzyme degradation over the test period.

Substantially similar results are obtained when other enzymes, such as SP-72 and SP-88, are used in composition D to replace Alcalase on an equal weight basis; or when an incompatible suds suppressor, bleaching agent, reducing agent or perfume is used as the additive component in place of the enzyme.

Substantially similar results are obtained when the additive component and encapsulating material are prilled, Marumerized, admixed, noodled or agglomerated.

Excellent results are also obtained when the encapsulating material of composition D is replaced by polyethylene glycol 20,000, the condensation product of tallow alcohol with about 30 moles of ethylene oxide or a mixture of about 25% by weight of polyethylene glycol 6000 with beeswax. The beeswax is replaced by paraffin wax, saran, triglyceride, ceresin, cellulose or maleic anhydride and excellent results are achieved.

EXAMPLE II

A liquid detergent composition having the following formulation was prepared by conventional methods:

| Ingredient | % (by weight) |
|---|---|
| Neodol 45-7 | 5 |
| 2.0r silicate (anhydrous) | 5 |
| 2.4r silicate (hydrous) | 20 |
| Triethanolamine | 25 |
| Sodium tripolyphosphate | 30 |
| Polyethylene glycol 4000 | 1 |
| SP-72 | 1.2 |
| Moisture and minors | balance |

The enzyme slurry, comprising a 1:1 mixture of enzyme and surfactant, was prilled using polyethylene glycol 6000 and then was added to the detergent composition. The storage stability of the composition was then tested using the method described above. The results were as follows, indicating that the enzyme contained in the composition exhibited little degradation over the test period.

| Time (Days) | Proteolytic Activity (Anson Units/g.) |
|---|---|
| ½ | .020 |
| 7 | .022 |
| 14 | .019 |
| 28 | .014 |

Substantially similar results are obtained when the nonionic surfactant of Example II is substituted with an ethylene oxide/propylene oxide condensate of trimethylol propane (commercially available as HA-433 from Wyandotte), or with a similar surfactant substituted with a substantially identical alkoxylate containing, instead of the trimethylol propane radical, an alkylol selected from the group consisting of propyleneglycol, glycerine, pentaerythritol, and ethylenediamine; or the condensation product of tallow alcohol with 9 or 20 moles of ethylene oxide.

EXAMPLE III

A paste detergent composition for use in an automatic dishwasher, having the following composition, is formulated:

| Component | Weight % |
|---|---|
| Neodol 45-7 | 5.8 |
| DB-544 (1) | 0.8 |
| Silicate solids (2.0r) | 14.0 |
| Triethanolamine | 27.0 |
| Sodium tripolyphosphate (anhydrous) | 35.0 |
| SP-88 (2) | 0.6 |
| Termamyl (3) | 0.6 |
| Water and minors | balance to 100 |

(1) a suds suppressor, commercially available from Dow Corning, which is a siloxane/glycol copolymer
(2) a proteolytic enzyme, commercially available from Novo Industrial A/S
(3) an amylolytic enzyme commercially available from Novo Industrial A/S The SP-88 and Termamyl enzymes are prilled with polyethylene glycol 6000 prior to their addition to the detergent composition.

EXAMPLE IV

A paste-form detergent composition for use in automatic dishwashers, having the following composition, is formulated:

| Component | Weight % |
|---|---|
| Ethylene oxide/propylene oxide condensate of trimethylol propane | 25.0 |

-continued

| Component | Weight % |
|---|---|
| Sodium cumene sulfonate | 10.0 |
| Silicate solids (2.0r) | 12.0 |
| Triethanolamine | 19.0 |
| Sodium tripolyphosphate (anhydrous) | 25.0 |
| SP-72 | 0.8 |
| Milezyme (1) | 0.4 |
| Monosteryl acid phosphate | 0.75 |
| DB 544 | 0.25 |
| Water and minors | Balance to 100 |

(1) an amylolytic enzyme available from Miles Laboratories, Elkhart, Indiana

The SP-72 and Milezyme enzymes are prilled with polyethylene glycol 6000 and Monomide S, in a ratio of 5:1 by weight, prior to addition to the detergent composition. The polyethylene glycol/Monomide S mixture constitutes 64% by weight of the total prill.

EXAMPLE V

A biodegradable, hydrous paste automatic dishwasher detergent composition, having the following formula, is prepared:

| Component | Weight % |
|---|---|
| Neodol 45-7 | 5.8 |
| Hydrous dry silicate (2.6r) | 24.0 |
| Triethanolamine | 27.9 |
| Sodium tripolyphosphate . $6H_2O$ | 35.0 |
| SP-88 | 1.5 |
| DB-544 | 0.8 |
| Moisture and minors | Balance to 100 |

The DB-544 suds suppressor and the SP-88 enzyme are separately prilled with polyethylene glycol 6000 prior to their addition to the detergent composition.

EXAMPLE VI

A composition, having the following formula, is prepared by melting the polyethylene glycol and then adding the remaining components:

| Component | Weight % |
|---|---|
| Nonsilica ultramarine purple | 0.25 |
| Benzene yellow (a pigment commercially available from DuPont) | 0.10 |
| SP-88 dry enzyme concentrate (activity = 5.7 Anson units/g) | 15.00 |
| Polyethylene glycol 6000 | 84.65 |

The composition is then prilled in Freon 113 and is incorporated into a paste-form detergent composition for use in an automatic dishwasher. The composition exhibits enzyme stability upon storage.

What is claimed is:

1. A method for preparing a liquid detergent composition containing a normally incompatible enzyme component, said composition consisting essentially of an effective amount of an enzyme component selected from the group consisting of proteolytic enzymes, amylolytic enzymes and mixtures thereof, from about 0.5% to about 30% by weight of water, up to about 10% by weight of said composition being present as free water, the remainder of the water being present as water of hydration, from about 0.5% to about 30% by weight of a surface active agent selected from the group consisting of anionic, nonionic ampholytic and zwitterionic surface active agents and mixtures thereof, and from about 40% to about 98% by weight of components selected from the group consisting of organic and inorganic builder materials, alkali materials, sequestering agents, china protecting agents, reducing agents, hydrotropes, corrosion inhibitors, soil suspending ingredients, drainage promoting ingredients, suds regulating agents, tarnish inhibitors, buffering agents, perfumes, dyes, inert carriers, and mixtures thereof, comprising encapsulating said incompatible enzyme component in a material, at least about 30% by weight of which is a water-soluble normally solid alkoxylated nonionic surface active agent selected from the group consisting of polyethylene glycol having a molecular weight from about 3000 to about 40,000, the condensation product of one mole of tallow alcohol with from about 20 to to about 80 moles of ethylene oxide and mixtures thereof, prior to the addtion of said incompatible enzyme component to the detergent composition.

2. The method of claim 1 wherein said detergent composition contains from about 0.05% to about 5% free water.

3. The method of claim 2 wherein said detergent composition has a total water content of from about 5% to about 25%.

4. The method of claim 3 wherein said surface active agent is an alkoxylated nonionic surface active agent, wherein the alkoxy moiety is selected from the group consisting of ethylene oxide, propylene oxide and mixtures thereof.

5. The method of claim 4 wherein said surface active agent comprises from about 1% to about 10% of said detergent composition.

6. The method of claim 5 wherein said encapsulating agent is combined with a water-insoluble agent selected from the group consisting of paraffin wax, beeswax, saran, triglycerides, and mixtures thereof.

7. A liquid detergent composition consisting essentially of:

(a) from about 0.5% to about 30% by weight of a surface active agent selected from the group consisting of anionic, nonionic, ampholytic and zwitterionic surface active agents;

(b) from about 0.5% to about 30% of water, up to about 10% of said composition being present as free water, the remainder of the water being present as water of hydration; and (c) an effective amount of a normally incompatible enzyme component selected from the group consisting of proteolytic and amylolytic enzymes and mixtures thereof, encapsulated in a material at least 30% by weight of which is a water-soluble normally solid alkoxylated nonionic surface active agent selected from the group consisting of polyethylene glycol having a molecular weight from about 3000 to to about 40,000, the condensation product of one mole of tallow alcohol with from about 20 to about 80 moles of ethylene oxide and mixtures thereof, and (d) from about 40% to about 98% by weight of components selected from the group consisting of organic and inorganic builder materials, alkali materials, sequestering agents, china protecting agents, reducing agents, hydrotropes, corrosion inhibitors, soil suspending ingredients, drainage promoting ingredients, suds regulating agents, tarnish inhibitors, buffering agents, perfumes, dyes, inert carriers, and mixtures thereof.

8. The composition according to claim 7 wherein the alkoxylated nonionic surface active agent is selected from the group consisting of polyethylene glycol having a molecular weight of from about 3000 to about 40,000, the condensation product of tallow alcohol with from about 20 to about 80 moles of ethylene oxide and mixtures thereof.

9. The composition according to claim 8 wherein said free water is present in an amount from about 0.05% to about 5% by weight.

10. The composition according to claim 9 wherein said composition has a total water content of from about 5% to about 25%.

11. The composition according to claim 10 wherein said surface active agent is present in an amount from about 1% to about 10%.

12. The composition according to claim 11 wherein said surface active agent is an alkoxylated nonionic surface active agent, wherein the alkoxy moiety is selected from the group consisting of ethylene oxide, propylene oxide, and mixtures thereof.

13. The composition according to claim 12 wherein said encapsulating agent is combined with a water-insoluble agent selected from the group consisting of paraffin wax, beeswax, saran, triglycerides, and mixtures thereof.

* * * * *